United States Patent [19]

Machcinski

[11] Patent Number: 4,468,073

[45] Date of Patent: Aug. 28, 1984

[54] ZERO INSERTION FORCE CONNECTOR

[75] Inventor: Stephen A. Machcinski, Winthrop, Mass.

[73] Assignee: Precision Connector Designs, Inc., Winchester, Mass.

[21] Appl. No.: 477,157

[22] Filed: Mar. 21, 1983

[51] Int. Cl.[3] ..... H01R 9/09

[52] U.S. Cl. ..... 339/74 R; 339/176 MP

[58] Field of Search ..... 339/75 MP, 74 R, 176 MP

[56] References Cited

U.S. PATENT DOCUMENTS

| | | | |
|---|---|---|---|
| 3,601,775 | 8/1971 | Longenecker et al. | 339/176 MP |
| 3,899,234 | 8/1975 | Yeager et al. | 339/74 |
| 3,963,317 | 6/1976 | Eigenbrode et al. | 339/74 R |
| 4,047,782 | 9/1977 | Yeager | 339/75 |
| 4,165,909 | 8/1979 | Yeager et al. | 339/75 MP |
| 4,179,177 | 12/1979 | Lapraik | 339/74 |
| 4,303,294 | 12/1981 | Hamsher, Jr. et al. | 339/74 |
| 4,403,819 | 9/1983 | Weber | 339/75 MP |

*Primary Examiner*—John McQuade

[57] ABSTRACT

A low insertion force electrical connector having a plurality of bent contacts with free ends that are movable by cam means in two stages in a cavity for receiving mating contacts on an electrical component.

8 Claims, 5 Drawing Figures

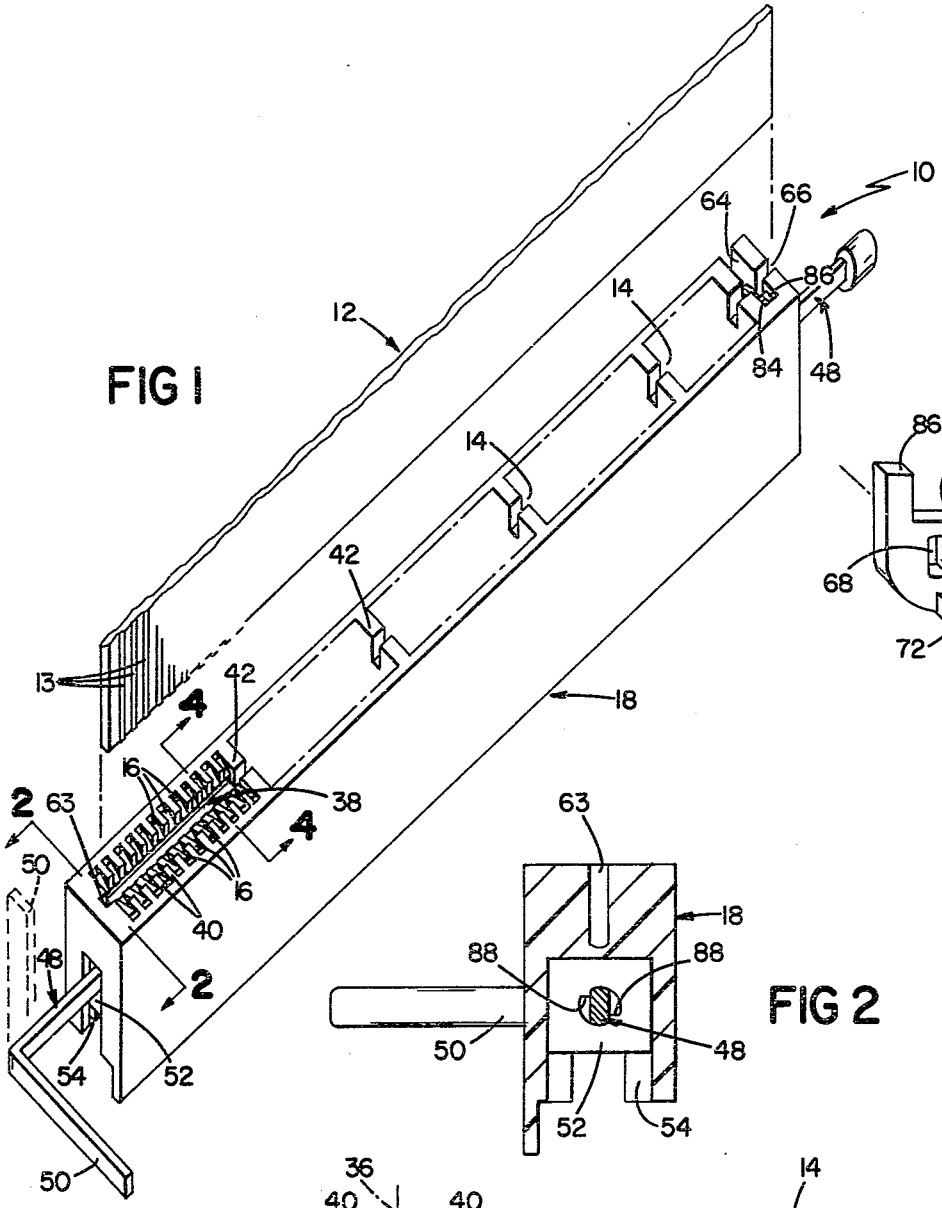
FIG 1
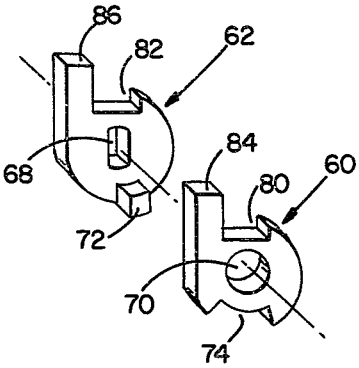
FIG 3
FIG 2
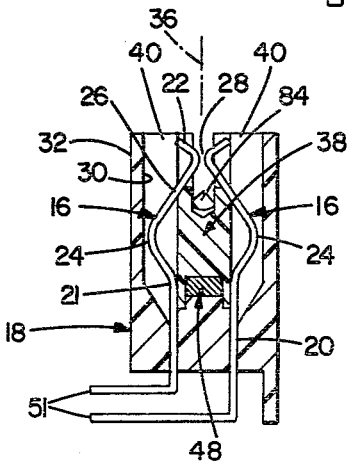
FIG 4
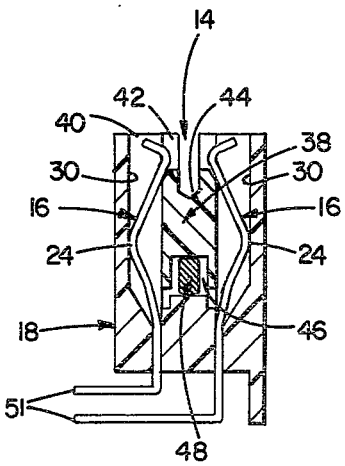
FIG 5

ZERO INSERTION FORCE CONNECTOR

FIELD OF THE INVENTION

The invention relates to a connector for making electrical connection with a plurality of contacts arranged at predetermined positions on an electrical component.

BACKGROUND OF THE INVENTION

Electrical connection is often made with printed circuit boards via electrical connectors employing opposing resilient contacts along the sides of an elongated cavity into which is inserted an edge of a the circuit board having corresponding contacts provided by metal surface portions. Some prior connectors have provided low insertion forces and subsequent increasing of normal forces between the connector contacts and the circuit board contacts through the use of cams to open the opposing resilient contacts prior to insertion of the circuit boards, e.g., U.S. Pat. Nos. 4,179,177; 3,899,234; 4,047,782; and 4,303,294.

SUMMARY OF THE INVENTION

In general the invention features a low insertion force connector having a plurality of bent contacts with free ends that are movable by cam means in two stages in a cavity for receiving mating contacts on an electrical component. Initially there is movement of the entire free lengths of the contacts until the bends in the contacts touch the inner sidewalls of the housing, and thereafter there is movement of the smaller lengths near the free ends. In such a connector, the contacts are initially pushed against a force that slowly increases with displacement of the free ends, and are thereafter pushed against a force that increases more quickly with displacement, to facilitate the operation of the cam means.

In preferred embodiments, the cam means includes a rotatable member connected to a lever arm having increased mechanical advantage when it is needed during the high force bending of the smaller lengths when the contact bends touch the sidewalls; the cam means includes a slidable pusher block between the rotatable member and inclined contact surfaces; there are opposing contacts with movable free ends at both sides of the cavity; means are provided to guarantee alignment of the contacts during actuation of the cam means; and means are provided to block a side entrance to the cavity when the contacts are in a closed position.

DESCRIPTION OF THE PREFERRED EMBODIMENT

The structure and operation of the presently preferred embodiment of the invention will now be described after first briefly describing the drawings.

DRAWINGS

FIG. 1 is a diagrammatic, perspective view of a connector according to the invention and a portion of a mating electrical component.

FIG. 2 is a vertical sectional view, taken at 2—2 of FIG. 1.

FIG. 3 is a diagrammatic, exploded perspective view of two components of the FIG. 1 connector.

FIGS. 4 and 5 are vertical sectional views, taken at 4—4 of FIG. 1, showing components of the FIG. 1 connector in different positions.

STRUCTURE

Referring to FIG. 1, there is shown connector 10 for making electrical connection with contacts 13 on electrical component 12 when it is inserted into elongated cavity 14. Two rows of connector contacts 16, shown in an open position in FIG. 1, are provided along opposite sides of opening 14 and are arranged to mate with contacts 13 on both sides of component 12.

Referring to FIGS. 4 and 5, electrical contacts 16 are secured in connector housing 18 at secured portions 20 and have free lengths 21 with bends 24 and inclined contact portions 26 between secured portions 20 and free ends 22. Contacts 16 are made of phosphor bronze alloy, CDA 510, 0.045" wide and 0.015" thick along most of free lengths 21. Contacts 16 are plated with nickel over the entire contacts and with gold at contact areas 28. Bends 24 have a 0.75" radius, and inclined contact portion 26 is at a 45° angle to both inner surface 30 of sidewall 32 of housing 18 and vertical axis 36 along which pusher block 38 slides between housing ribs 40 separating adjacent contacts 16 (FIG. 1).

There are five pusher blocks 38 in connector 10 between guide ribs 42 for guiding component 12. Housing 18 and pusher blocks 38 are both made of glass filled polyester. Pusher blocks 38 have upper recesses 44, to provide space for component 12, and lower recesses 46, within which actuating bar 48 is located. Actuating bar 48 (301 stainless steel, passivated, ½ hard) is 0.055" thick and 0.125" wide. Bar 48 has curved edges (0.125" radius) to facilitate camming action against pusher block 38 during rotation from the position of FIG. 4 to that of FIG. 5. The end of bar 48 is bent to provide lever arm 50.

Connector contact ends 51 extend from the bottom of contact 10 to make electrical connection with a printed circuit board or other component.

Referring to FIG. 2, there is shown metal stop plate 52 provided in recess 54 of the side of connector 10 near lever arm 50. It permits 90° rotation of actuating bar 48 between the positions shown in FIG. 1 and prevents further rotation beyond stop surfaces 88.

Referring to FIGS. 1 and 3, blocking member 60 and alignment member 62 are mounted on actuating bar 48 in recess 64 to guarantee proper alignment of contacts 13 with contacts 16 and to prevent component 12 from being slid into side opening 66 of cavity 14 when opposing contacts 16 are in the closed position of FIG. 4. Member 62 has flat-sided hole 68 for mating with actuating bar 48 so that it rotates with bar 48. Blocking member 60 has circular hole 70, permitting free rotation of actuating bar 48 through it. Transverse tab 72 of member 62 mates with track 74 of member 60. Members 60, 62 are sandwiched between portions of plastic housing defining recess 64 to resist rotation of member 60.

OPERATION

In use, prior to insertion of the edge of electrical component 12 into cavity 14, lever arm 50 is rotated to the position shown in solid in FIG. 1 so that contacts 16 are open (FIG. 5) owing to the action of the rotation of actuating bar 48 against pusher block 38. During initial actuation of lever arm 50, when small rotation of bar 48 results in relatively large vertical movement of pusher block 38, horizontal force against contacts 16 increases slowly with horizontal displacement, because the entire free lengths 21 of contacts 16 are moved. Thus, although the leverage or mechanical advantage of arm 50 is small during initial rotation, the forces against which it acts are also small. After bends 24 contact inner sidewalls 30, continued vertical movement of pusher block 38 results in moving the remaining small free lengths of contacts 16, and the increase in force with a given horizontal displacement is much larger. During this later rotation of bar 48, there is smaller vertical movement of pusher block 38 for a given rotation, and this results in increased leverage or mechanical advantage for use in pushing against the larger forces. Thus, the two stage bending of contacts 16 results in an overall smoother operation. In the position shown in FIG. 4, contact areas 28 are about 0.010" apart; in the position shown in FIG. 5, contact areas 28 are approximately 0.075" to 0.080" apart.

Once opposing contacts 14 are thus opened, the edge of electrical component 12 is either inserted downwardly into cavity 14 from the position shown in FIG. 1 or is inserted tranversely through side opening 66 along the length of opening 14. (e.g., component 12 would be slid transversely through openings 66 of two such connectors 10 where three such connectors 10 are used for engaging three edges of a rectangular printed circuit board.) The vertical edge of component 12 touches side wall 63, closing the end of cavity 14, thereby aligning contacts 13 and contacts 16. When lever arm 50 is positioned as shown in solid in FIG. 1, members 60, 62 are in the positions shown in FIG. 3 with their upper recesses 80, 82 directed upwardly to permit transverse travel of component 12 through them. As lever arm 50 is then rotated back to the position shown in phantom in FIG. 1, pusher block 38 is forced downward owing to the spring action of contacts 16, and contact areas 28 move toward each other and engage contacts 13 on component 12. During rotation, member 62 rotates with actuating bar 48 through side opening 66 and prevents rotation of actuating bar 48 if a portion of component 12 is within its upper recess 82, owing to interference of arm 86. As member 62 rotates with bar 48, its tab 72 eventually contacts the radial edge partially defining track 74, causing member 60 to rotate with member 60, upper arm 84 of member 62 being staggered relative to upper arm 86 of member 62, so that it blocks the opening 66 to cavity 14 when bar 48 is the position shown in FIG. 4.

OTHER EMBODIMENTS

Other embodiments of the invention are within the scope of the appended claims.

What is claimed is:

1. A connector for making electrical connection with a plurality of first contacts arranged at predetermined positions on a component, said connector comprising a housing having a cavity for receiving said contacts, a plurality of second contacts secured at secured portions to said housing, said contacts being resilient, having free ends movable within said cavity in a first direction against the contact surfaces of said first contacts, having bends between said free ends and said secured portions at positions adjacent to interior housing sidewall surfaces, and having inclined contact portions between said free ends and said secured portions and being inclined relative to a second direction at an angle to said first direction, and cam means for pushing in said second direction against said inclined contact portions to cause them to move in said first direction, initially moving the entire free lengths of said contacts between said secured portions and said free ends until said bends touch said sidewalls, and thereafter moving the portions between said bends and said free ends.

2. The connector of claim 1 wherein said cavity is elongated, and said cam means comprises a rotatable cam member connected to a lever arm.

3. The connector of claim 2 wherein said rotatable cam member is a bar, and said cam means further comprises a pusher block between said bar and said connector contacts.

4. The connector of claim 2 wherein at one end of said elongated cavity there is a side opening through which said electrical component can be slid, the other end of said elongated cavity being closed, and further comprising first means on said rotatable member for passing through said side opening during pushing of said free lengths in said cavity to guarantee alignment of said first contacts and said second contacts.

5. The connector of claim 4 further comprising second means on said rotatable member and adjacent to said first means for blocking said side opening when said bends are not touching said sidewalls.

6. The connector of claim 4 wherein there is a row of connector contacts on each side of said elongated cavity, and wherein said rotatable cam member is a bar, and said cam means further comprises a pusher block between said bar and said connector contacts.

7. The connector of claim 6 wherein said housing comprises guide ribs separating adjacent connector contacts.

8. The connector of claim 6 further comprising means to prevent said bar from rotating more than 90°.

* * * * *